United States Patent [19]

Quets et al.

[11] 4,085,037

[45] Apr. 18, 1978

[54] PROCESS FOR SEPARATION OF NON-MAGNETIC PARTICLES WITH FERROMAGNETIC MEDIA

[75] Inventors: Jean Marie Quets; Henri Hatwell, both of White Plains, N.Y.

[73] Assignee: Union Carbide Corporation, New York, N.Y.

[21] Appl. No.: 644,806

[22] Filed: Dec. 29, 1975

[51] Int. Cl.[2] ..... B03B 5/30

[52] U.S. Cl. ..... 209/1; 209/172.5; 210/42 S

[58] Field of Search ..... 210/42; 209/1, 173, 209/172, 172.5, 174, 175; 252/62.51, 62.52, 62.53; 266/205, 207, 2

[56] References Cited

U.S. PATENT DOCUMENTS

| | | | |
|---|---|---|---|
| 3,284,630 | 11/1966 | Peshin | 252/62.53 |
| 3,294,685 | 12/1966 | Stevens | 252/62.51 X |
| 3,483,968 | 12/1969 | Kaiser | 209/1 |
| 3,483,969 | 12/1969 | Rosensweig | 209/1 |
| 3,672,872 | 6/1972 | Bonnier | 210/42 X |
| 3,697,420 | 10/1972 | Blaisdell | 210/42 |
| 3,855,137 | 12/1974 | Whitney | 252/62.52 |
| 3,951,784 | 4/1976 | Kaiser | 209/1 |

OTHER PUBLICATIONS

Journal of Applied Physics, 41, No. 3, Mar. 1970, 1064–1072.

IEEE Trans. of Magnetics, vol. MAG-6, No. 3, Sept. 1970, 694–698.

*Primary Examiner*—Robert Halper

*Attorney, Agent, or Firm*—Richard G. Miller

[57] ABSTRACT

Particles of different densities are separated from admixture by ferrohydrodynamic movement in a liquid magnetic medium into zones thereof and retained in said zones upon solidification of said liquid medium.

6 Claims, 4 Drawing Figures

PROCESS FOR SEPARATION OF NON-MAGNETIC PARTICLES WITH FERROMAGNETIC MEDIA

Figure 1A:
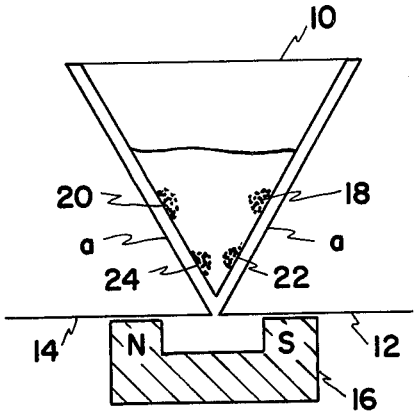

The present invention relates in general to the separation of particles on the basis of their density. More particularly it relates to a process for particle separation using magnetic levitation in a magnetic fluid medium which is readily solidifiable, thereby immobilizing separated particles and preventing their reintermixing, and to apparatus for carrying out the process.

The static and dynamic processes associated with the motion and pressure distribution induced in incompressible magnetically polarizable fluids when in the presence of an appropriate field gradient are known in the art by the term ferrohydrodynamics. In U.S. Pat. No. 3,488,531 issued to R. E. Rosensweig on Jan. 6, 1970, there is disclosed a theoretical methematical analysis of the applicable laws of physics whereby bodies which are normally non-responsive to magnetic fields can be moved by such a field. In the practical application of these principals a system is described wherein a non-magnetic particle is immersed in a container of ferromagnetic fluid medium comprising a colloidal dispersion of ferrite particles in kereosene. The particle has a density greater than the density of the fluid medium. By placing a permanent magnet against the outside bottom of the container, a non-uniform magnetic field is caused to pass through the ferromagnetic fluid. Initially, the force applied to the system originates from the attraction of the magnetic field upon the particles suspended in the carrier fluid. The particles then transmit the force to the body of the fluid with the result that a body force appears throughout the fluid. The ferromagnetic mixture can be considered homogeneous with regard to its behavior in the applied field, and the magnetic field acting upon every unit volume of the magnetizable fluid creates a different distribution of static pressure in order to establish a balance of forces. The fluid pressure thereby produced at any point in the fluid is free to push upon any surface with which it is brought in contact. In the system here concerned, the pressure on the bottom of the non-magnetic particle introduced into the liquid magnetic medium was caused, by the placement of the permanent magnet, to exceed the pressure of the top of the particle and hence it moved upwardly against the force of gravity.

By applying the magnetic field in such a manner that the force is opposed to the force of gravity thereon, a buoyancy can be created for dense particles which is directly related to their density. Thus when a mixture of particles having different densities is placed in a magnetic fluid, those of higher density can be made to "sink" and those of lesser density can be made to "float" by appropriate control of the imposed magnetic force and a particle separation obtained by separating that portion of the liquid magnetic fluid containing particles of like density from the bulk of the said fluid and mechanically isolated the desired particles therefrom.

In processes of these kinds the degree of segregation of particles from admixture which is attained by means of the imposed magnetic field is maintained only during the period of imposition of the field. Absent the applied magnetic force, the magnetic fluid assumes the properties of ordinary fluids and the separated particles become again intermixed under the unopposed force of gravity. Accordingly, the prior proposed processes require the use of magnetic field generators during the entire separation process, including the isolation of the separated particles from the system. It would therefore be highly advantageous to be able to utilize the energy required to establish the magnetic field only during the period in which the particles of various densities are moved within the medium to accomplish segregation.

It is the principal object of the present invention to utilize the energy required to establish the magnetic field only during the period in which the particles are separated and thereafter to rely upon a change of state of the magnetic fluid to immobilize the particles in the separated state. Another object of this invention is to extend the use of magnetic levitation as a means of particle separation to particles of the order of one micrometer in diameter. A still further object is to provide automatic devices which can perform particle separations quickly and efficiently with little or no manual handling.

The principal object of the present invention is achieved by the process embodiment which comprises providing a magnetic fluid which can be converted to the solid state, said fluid also containing a mixture of at least two particles of different density, both of which are greater than the actual density of the magnetic fluid medium, imposing a non-uniform magnetic field upon said particles and said magnetic fluid whereby the said particles are moved within said magnetic fluid and segregated into different zones thereof in accordance with the respective densities of the particles, solidifying at least a portion of the magnetic fluid to retain the particles contained therein, and optionally mechanically separating at least one of the zones from the overall magnetic fluid and recovering the particles therefrom.

The particular magnetic liquid medium employed in the practice of the present invention is not a critical factor. A variety of these compositions and the method for their preparation have been proposed in the prior art. S. S. Papell in U.S. Pat. No. 3,215,572 of Nov. 2, 1965 has disclosed a propellant containing magnetic particles. Papell also described colloidal magnetic fluids with O. C. Faber in NASA report TN D-4676 of August 1968. U.S. patents dealing with magnetic fluids are Rosensweig, U.S. Pat. No. 3,531,413 of Sept. 29, 1970 on the substitution of one solvent for another and Reimers and Khalafalla, U.S. application, Ser. No. 275,382, now U.S. Pat. No. 3,843,510 on preparation of peptization. Other publications on the properties of magnetic fluids are NASA report CR-1407 of 1969 by R. Kaiser and an article in the Journal of Applied Physics 41, 1064 (1970) by R. Kaiser and G. Miskolczy. The aforesaid magnetic fluid media comprise kerosene, xylene, silicone oils, fluorocarbons, organic esters and water. Waxes are also suitably employed as media in magnetic fluids in the practice of the present invention. The term "wax" is used herein in its conventional sense and includes all to the natural and synthetically prepared compositions which resemble in properties beeswax and paraffin wax, two waxes which typify the two general classes of waxes, namely, oxygenated waxes and aliphatic hydrocarbon waxes, respectively. Aliphatic hydrocarbon waxes are those of petroleum, mineral or synthetic origin which are characterized by their predominate content of paraffinic hydrocarbons having molecular weights of greater than about 190. The most common and readily available of these waxes are the conventional paraffin waxes derived from petroleum refining, but ceresin and ozocerite waxes derived from mineral sources are also readily available and are suitable for use in the present compositions. Also suitable are the synthetic polyethylene waxes.

The oxygenated waxes, as the term is used herein, are principally those of animal, insect or vegetable origin and are characterized by a predominate content of high molecular weight acids, alcohols and non-glycerol esters of long chain organic acids. Common wax acids include cerotic, lauric, myristic, palmitic, polymetic and melissic. Common alcohols which can be present as free alcohols or as esters of the aforesaid acids in oxygenated waxes are cetyl, ceryl, stearyl and myricyl. Important oxygenated waxes include beeswax carnauba, ouricury, palm, raffia, Japan, esparto, spermaceti and bayberry. Synthetic oxygenated waxes which exhibit many of the properties of their naturally occurring counterparts include the esterification products of polyethylene glycol or sorbitol with stearic acid, and the reaction product of maleic anhydride and polyethylene.

A superior and particularly preferred class of wax compositions for use in the present invention are those disclosed in copending application Ser. No. 645,039 filed Dec. 29, 1975 and entitled "Superparamagnetic Wax Compositions", now U.S. Pat. No. 4,025,448. As disclosed therein, ferromagnetic wax mixtures in which the wax content consists of from 10 to 90 weight percent of an aliphatic hydrocarbon wax and complimentarily from 90 to 10 weight percent of an oxygenated wax are uncommonly stable toward phase separation of the colloidal ferromagnetic particles when subjected to numerous freeze-melt cycles.

The particular superparamagnetic material colloidally dispersed in the medium is not a critical factor. Preferably, materials having the highest magnetic susceptibility such as iron, magnetite, cobalt or nickel are employed so that the saturation magnetization of the final composition will be at least 1.0 gauss when the superparamagnetic material constitutes 80 weight percent. When iron or magnetite is used as the superparamagnetic colloid material in amounts of from 1 to 70 weight percent the saturation magnetization of the ferromagnetic medium ranges from 10 gauss to 700 gauss. It is preferred that this property ranges from 50 to 400 gauss. It has apparently become common practice in the art to refer the entire class of superparamagnetic materials as "ferromagnetic" even in the absence of iron in their composition. Unless the contrary is indicated, that practice will be adhered to herein and in the claims.

The size of the colloidal ferromagnetic particle can vary between 30 and 3,000 A. In any real preparation there will be a distribution of particle size. The most favorable range will average between 50 and 150A in size, the most preferred size averaging 100 A.

Since the superparamagnetic materials are inorganic in nature, they are much more polar than the dispersing medium. Perhaps more importantly, when in colloidal form the superparamagnetic materials have high surface areas and secondary bonding forces which would lead to agglomeration of the colloid except for the presence of a stabilizing or dispersing agent adsorbed on the surface of the colloidal iron, magnetite, cobalt, nickel, or other superparamagnetic material. Characteristically, a surface-active agent adsorbed on the colloid has a polar portion in direct contact with the polar surface and a non-polar portion available for solvation by the continuous organic phase. The stabilizing agent or dispersant thus helps prevent agglomeration of the colloidal particles via their intrinsic self-attraction as well as providing solvation sites.

The particular surface-active agent or dispersing aid which is employed is not a critical factor. To fulfill their function of forming monolayers or thin layers at the interface of phases of differing polarity, these compounds have polar, hydrophilic, and nonpolar, oleophilic, moieties in the molecule. Surface-active agents can be divided into three classes depending on whether the polar group is positively charged, negatively charged, or uncharged. Those agents which are positively charged are called cationic and this class can be illustrated by the organically substituted ammonium salts such as benzyltrimethylammonium chloride. Those agents which are negatively charged are termed anionic and this class can be illustrated by salts of organic fatty acids (soaps), organosulfosuccinates, sulfonated alkylaryl compounds (detergents),, alkylated phenols, fatty acids themselves, sulfate salts, and phosphate salts. The uncharged class are termed non-ionic and this class generally is made up of reaction products of ethylene oxide such as alkylated ethoxylated phenols, ethoxylated mercaptans, ethoxylated sugars, and ethyoxylated ethers. These types of compounds can be used as dispersants in the formulation of the superparamagnetic compositions used in the present invention. Particularly preferred as a dispersant in the case of waxes or kerosene, is oleic acid. Ethoxylated alkyl pheno is also an especially good dispersant in those cases. The optimum amount of surface active agent employed is dependent in part upon the average particle size of the colloidal particles suspended in the medium since, in general, more dispersant is necessary for high surface-area colloids than for low surface-area colloids. Generally, from 1 to 20 weight percent of the surface active agent can be employed based on the overall composition weight. It is particularly preferred to use from about 1/5 to ⅓ the amount of surface active agent as the weight of colloid superparamagnetic material present, up to a maximum of 20 weight-% as hereinbefore indicated.

The means of solidifying the magnetic liquid after separating the particles include both physical and chemical methods. The physical method will most commonly be by temperature reduction to solidify the medium, but can also include removal of a solvent phase from a normally solid solute. Chemical solidification can include the use of chemical agents which react with or catalyze the inter-se reaction of the liquid medium to form a solid reaction mass, as for example the use of a coagulating agent in a latex medium, or a polymerization promoter in a monomeric medium such as styrene. Radiation energy can also be used to cause chemical reactions and subsequent solidification of a variety of normally liquid substances.

Various techniques for preparing ferromagnetic fluids are described in U.S. Pat. Nos. 3,531,413; 3,843,540; 3,215,572 and in the aforesaid copending application Ser. No 645,039 filed Dec. 29, 1975 and entitled "Superparamagnetic Wax Compositions", all of which are incorporated herein by reference.

The particle mixture which is separated into at least two components on the basis of density according to the present invention must contain particles of two densities which differ from each other preferably by 1 to 3 grams per cubic centimeter. The chemical nature and source of the particles is not a criticl factor, provided of course that the particles do not react with each other or the magnetic fluid under the conditions of the separating process.

To process a raw material by the present process in the most efficaceous manner it is desirable in some instances to pretreat the starting mass in one or more ways. For example, if the raw material is wet with water or other liquids which tend to interfere with the properties of the ferromagnetic composition, the removal of such liquids is advisable. Depending on its initial condition, it may be desirable or necessary to crush the feed material into granular form small enough to liberate the phases of different density Frequently granulation to particles of about 25 mm or less is required for this purpose. It can also be advantageous to carry out a sizing step, usually employing screens or sieves. In the separation process it is also advantageous to treat sized fractions separately, because exposing samples of discordant sizes to the ferromagnetic separating apparatus at the same time may prevent equal exposure of each particle or granule to the levitating process. Larger pieces can carry along adhering smaller pieces of different density. Therefore, it is preferred practice to treat materials within a maximum diameter ratio of 5 to 1, preferably 3 to 1, and if possible, 2 to 1 at the same time.

It is also highly desirable as a pre-treatment step to remove all strongly magnetic particles with a permanent magnet before exposing the sample to ferromagnetic levitation, because magnetic particles will stick to the electromagnets or permanent magnets of the separating device, eventually causing partial blockage or sludging in the apparatus. This can be accomplished on a commercial scale by conventional magnetic separators for removing tramp iron.

The particles of raw material can be fed into the process system alone or with the magnetic medium premixed with feed particles for quicker dispersion in the ferromagnetic fluid. Normally one would add the feed to the top of the separatory zone, but this is not necessary since equilibrium between gravity and magnetic levitation in the magnetic gradient is independent of where the particles enter the separatory zone.

The actual separation of particles or objects of different density takes place in the gradient of a magnetic field. The ferromagnetic composition must be liquid at this point so that the particles can diffuse. The magnetic liquid and particles may move through a stationary magnetic field, or the magnetic field may move over a stationary ferromagnetic liquid and particle mixture. In principle, there is no upward limit to the size of objects which can be separated by magnetic levitation. The lower limit occurs at the point where the particles to be separated approach colloidal size. There may be one or a plurality of separating zones of different magnetic gradient. The separating zone can have transporting means directly in it, or collecting means in it, it being necessary only that magnetic levitating separation takes place in a magnetic gradient while the ferromagnetic medium is liquid. Once a physical separation of fractions of different density has been made in the ferromagnetic liquid, this separation is "locked-in" by solidifying the liquid by physical or chemical means. After solidification has fixed the separation, then isolation of the separated particles from the system is readily accomplished by conventional means.

After collection of the various density fractions, the particles are separated from the ferromagnetic wax either by solvents or melt-decantation or both. The solvents used will depend on the type of wax base employed, that is, paraffin, carnauba, beeswax, ceresin, Fischer-Tropsch, higher fatty acid containing from 122 to 30 carbon atoms, and the like. Because all such waxes are oleophilic, low-boiling hydrocarbon or halogenated hydrocarbon solvents such as hexane, methylene chloride, trichlorethylene are the most appropriate for freeing ferromagnetic wax from the separated particles. Low-boiling solvents are desirable for two reasons: they are most easily removed from the particulate mineral or metal fractions being processed, and they are most easily volatilized from the ferromagnetic wax so it can be recycled to the apparatus. Depending on the quantity of material being processed, the apparatus and processes described above can be run batch-wise with no recycling of the magnetic medium, semi-continuously with intermittent recycling of the magnetic medium, or continuously.

The process of the present invention and apparatus suitable for the practice of same are illustrated in the following examples.

Figure 1B:
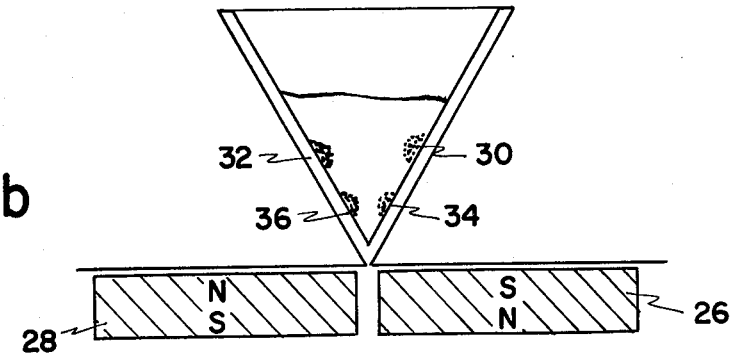
Figure 1C:
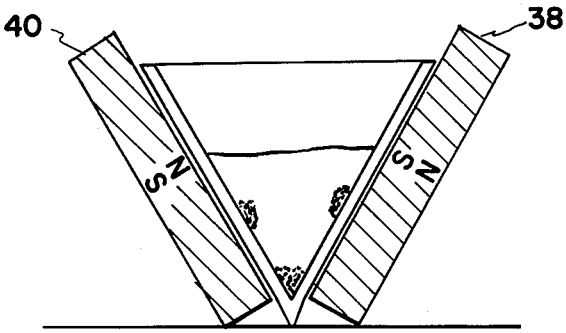

In the drawings:

FIG. 1*a*, 1*b* and 1*c* are cross-sectional views of a batch-type mold apparatus for ferrohydrodynamic particle separation showing three different placements of the source of the magnetic field.

Figure 2:
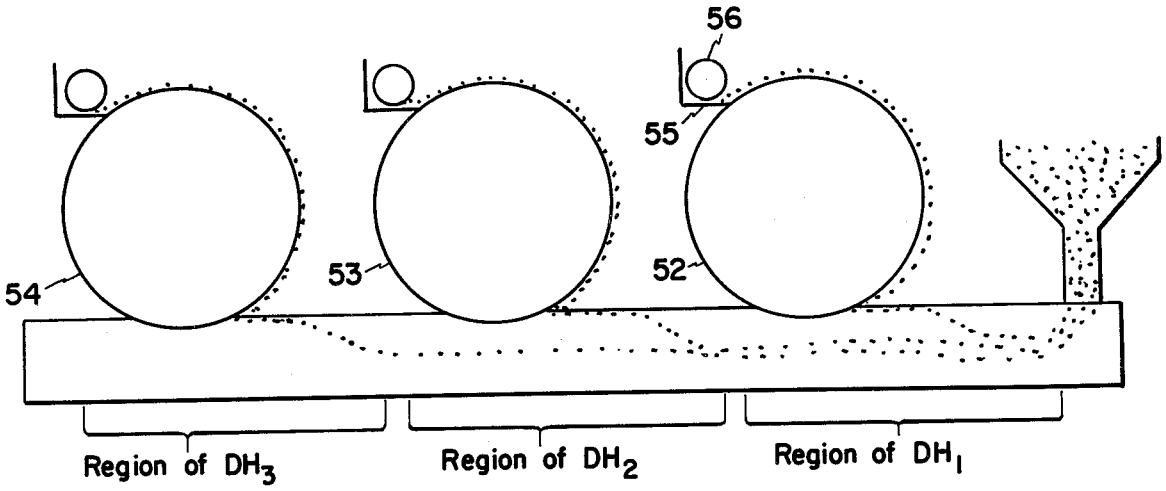

FIG. 2 is a schematic representation of a three-wheel series separator using magnetic wax for the separation of a particle mixture into three fractions of different densities.

EXAMPLE 1

(a) A ferromagnetic fluid comprising 67 percent by weight kerosene, 25 percent by weight colloidal magnetite and 8 percent by weight oleic acid dispersant, and having a saturation magnetization of 250 gauss was prepared by the peptization method of U.S. Pat. No. 3,843,540. To 225 grams of this fluid was added 150 ml. of acetone with stirring, causing agglomerization of the colloidal magnetite. The agglomerated mass of precipitate was held in place at the bottom of the beaker with a laboratory magnet, while the kerosene and acetone were poured off. The precipitate was washed with two 50-ml portions of acetone, which were poured off in the same manner, and then the sludge was allowed to air dry in a hood for 30 minutes. Then a premelted mixture of 360g. of medium-grade paraffin wax, melting at 52° C, and 90 g. of white beeswax U.S.P. was added and warmed to about 65° C. to remove any residual acetone. This ferromagnetic wax had a melting range of 50–60° C. and a saturation magnetization of 80 gauss.

With reference to FIG. 1*a* of the drawings, about 100 ml. of the ferromagnetic wax composition prepared above was heated to 90° C and poured into copper mold 10 which is essentially a V-shaped end-sealed trough whose sides form an angle of about 60° with each other. The trough capacity was approximately 100 ml. Supporting members 12 and 14 were each constructed of a steel sheet, 6 × 6 × 3/64 inches bent in the middle at a 60° angle. An Alnico channel magnet 16 placed directly beneath mold 10 and extending along the entire 6 inch length thereof provided the magnetic field required. Onto the surface of the molten wax in the mold 10 was sprinkled about 10 grams of a mixture of equal parts by weight of powdered copper and powdered aluminum having particle sizes of about 0.5 mm. After 15 minutes the molten wax had solidified and was removed from the mold. The less dense aluminum particles formed two bands 18 and 20 about 1 mm. above the two bands 22 and 24 formed by the more dense copper particles. Sectioning of the solidified wax mass through line *a—a* completed the separation of the particle mixture.

(b) Using the same ferromagnetic wax, metal particle mixture and procedure as in part (a) supra., a similar separation of the particles was accomplished using the apparatus of FIG. 1*b*, which differs from that of FIG. 1*a* only in that the Alnico channel magnet of the latter was replaced by two ferrite permanent magnets 26 and 28, each of which was 6 × 4 × ¾ inches. These magnets also extended the full length of the copper mold. The vertical distance space between the aluminum particle zones 30 and 32 and those of the copper particles 34 and 36 was about 1½ millimeters.

(c) Using the same ferromagnetic wax, metal particle mixture and procedure as in part (a) supra, a similar separation of the particles was accomplished using the apparatus of FIG. 1*c* which differs from that of FIG. 1*a* only in that (i) the Alnico channel magnet of the latter was replaced by two ferrite permanent magnets 38 and 40, each of which was 6 × 4 × ¾ inches, said magnets being positioned along the entire length of, and in contact with the vertical members of the support for the copper mold containing the ferrowax fluid, and (ii) the horizontal members of said support were affixed to a horizontal steel plate. The separation of the copper particles from the aluminium particles was similar to that of part (a) except that the copper particles were all moved into the apex of the trough-shaped mold instead of appearing as a deposition band along the vertical side wall thereof.

EXAMPLE 2

The separation of a particle mixture into a large number of density fractions on a continuous basis is readily accomplished using an apparatus of the type illustrated in FIG. 2. With reference to the drawing, a mixture of ferromagnetic wax composition, such as described in Example 1*a* supra, containing a mixture of particles more dense than the wax is fed through funnel 50 into tank 51 containing additional ferromagnetic wax in the molten state. Positioned in tank 51 and slightly immersed in the molten ferrowax therein are cooled rollers 52, 53 and 54, which during the course of the separation process are continually rotated. The configuration of the tank 51 and the placement of rollers 52, 53 and 54 are such that any particle moving along the length of tank 51 from the entry point of funnel 50 towards roller 52 and which is nearer the surface of the molten wax level in tank 51 than the depth of submiersion of roller 52, would impinge on the surface of said roller 52. Three different magnetic field gradients are imposed on the ferromagnetic wax medium in the tank and situated such that in the first gradient zone $DH_1$ the least dense particles of the mixture, fraction $d_1$, is levitated to the surface of the wax medium and as the particles move along the tank impinge on roller 52. As roller 52 rotates a film of wax and entrapped levitated particles is carried on its surface and solidifies. Scraper 55 continually removes the solidified wax and particle mass and conveyance means 56 removes the mass to means for recovering the particle fraction $d_1$ and returning the wax to the process system. The remaining particle fractions passing beneath roller 52 enter a more intense gradient zone $DH_2$ wherein a more dense fraction of particles is levitated sufficiently to impinge on roller 53, and in like manner as with roller 52, the particles are recovered from the film of wax and particles removed from tank 51 by action of roller 53. In similar fashion a third and more dense particle fraction is isolated by means of roller 54.

EXAMPLE 3

Using essentially the same apparatus and procedure as in Example 1 (*a*) supra and using as the magnetic fluid a water medium containing sufficient colloidal magnetite to provide a saturation magnetization of 200 gauss, a mixture of particles consisting of silicon dioxide and lead oxide is separated into two zones. After the silicon dioxide has been levitated to a higher zone than the lead oxide in the liquid medium, liquid nitrogen is used to freeze the medium. The solid medium is then removed from the apparatus and the lead oxide recovered by selectively melting the magnetic medium zone in which it is retained in the solid state.

What is claimed is:

1. Process for separating solid particles from admixture which comprises providing a homogeneous ferrohydrodynamic medium containing a colloidal suspension of superparamagnetic particles therein, said medium being in the molten state and also containing a mixture of at least two non-colloidal non-magnetic particles of differing densities both of which are greater than the actual density of the medium, imposing a non-uniform magnetic field upon said particles and said ferrohydrodynamic medium whereby the said particles are moved within said medium and segregated into different zones thereof in accodance with the respective densities of the particles, solidifying the liquid medium constituting at least one of said zones to immobilize the particles as segregated therein and to prevent the introduction thereinto of extraneous particles.

2. Process according to claim 1 wherein a sufficient portion of the ferrohydrodynamic liquid is solidified that the solid portion contains at least two zones, one of which contains a predominance of particles having densities less than that of the predominance of particles in the second zone.

3. Process according to claim 1 wherein the mixture of particles being separated consists essentially of particles having diameters of from about 0.03 to 1.0 millimeters and the diameter of the largest particles is not greater than five times that of the smallest particles.

4. Process for separating solid particles from admixture which comprises providing a homogeneous ferrohydrodynamic medium containing a colloidal suspension of superparamagnetic particles therein, said medium being a wax in which the transition from the liquid state to the solid state occurs above 40° and below 100° C, said medium being in the molten state and also containing a mixture of at least two non-colloidal non-magnetic particles of differing densities both of which are greater than the actual density of the medium, imposing an non-uniform magnetic field upon said particles and said ferrohydrodynamic medium whereby the said particles are moved within said medium and segregated into different zones thereof in accordance with the respective densities of the particles, solidifying the liquid medium constituting at least one of said zones to immobilize the particles as segregated therein and to prevent the introduction thereinto of extraneous particles.

5. Process according to claim 4 wherein the temperature range over which the transition from the solid to the liquid state occurs is less than 10° C.

6. Process according to claim 4 wherein the wax contains from 10 to 90 weight percent hydrocarbon wax and from 10 to 90 weight percent oxygenated wax.

* * * * *